US009789533B2

(12) United States Patent
Aoki et al.

(10) Patent No.: US 9,789,533 B2
(45) Date of Patent: Oct. 17, 2017

(54) SAND FOR CASTING MOLD, MANUFACTURING METHOD FOR SAND CASTING-MOLD, AND CORE FOR METAL CASTING

(71) Applicants: SINTOKOGIO, LTD., Nagoya-shi, Aichi (JP); TOYOTA JIDOSHA KABUSHIKI KAISHA, Toyota-shi, Aichi (JP)

(72) Inventors: Tomohiro Aoki, Toyokawa (JP); Yusuke Kato, Toyokawa (JP); Takehiko Matsumoto, Toyokawa (JP); Kenichiro Mori, Toyokawa (JP); Toshihiko Zenpo, Tokyokawa (JP); Tomokazu Suda, Toyota (JP); Masaomi Mitsutake, Toyota (JP); Takumi Maegawa, Toyota (JP); So Nakayama, Nisshin (JP); Masashi Morikawa, Seto (JP); Hirotsune Watanabe, Miyoshi (JP)

(73) Assignees: SINTOKOGIO, LTD., Toyota (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 126 days.

(21) Appl. No.: 14/442,233

(22) PCT Filed: Nov. 8, 2013

(86) PCT No.: PCT/JP2013/080314

§ 371 (c)(1),
(2) Date: May 12, 2015

(87) PCT Pub. No.: WO2014/077203

PCT Pub. Date: May 22, 2014

(65) Prior Publication Data

US 2016/0121388 A1 May 5, 2016

(30) Foreign Application Priority Data

Nov. 19, 2012 (JP) ..... 2012-253658

(51) Int. Cl.
*B22C 1/02* (2006.01)
*B22C 9/02* (2006.01)
(Continued)

(52) U.S. Cl.
CPC ..... *B22C 1/02* (2013.01); *B22C 9/02* (2013.01); *B22C 9/10* (2013.01); *B22D 21/04* (2013.01)

(58) Field of Classification Search
CPC .... B22C 1/02; B22C 1/10; B22C 1/16; B22C 1/20–1/26; B22C 9/02; B22C 9/10
(Continued)

(56) References Cited

U.S. PATENT DOCUMENTS 4,111,253 A 9/1978 Epstein et al.
4,131,474 A * 12/1978 Uchikawa ..... B22C 1/167 106/38.3
(Continued)

FOREIGN PATENT DOCUMENTS

CN 1921969 A 2/2007
JP S62-144847 A 6/1987
(Continued)

OTHER PUBLICATIONS

Nov. 17, 2015 Office Action issued in Chinese Patent Application No. 201380060137.X.
(Continued)

*Primary Examiner* — Kevin E Yoon
(74) *Attorney, Agent, or Firm* — Oliff PLC

(57) ABSTRACT

Sand for a casting mold including sand, a binder, and an inorganic compound particle having poor water solubility
(Continued)

and generating a gas, which is at least one of water vapor or carbon dioxide gas, by heat from a molten metal.

19 Claims, 2 Drawing Sheets

(51) Int. Cl.
*B22D 21/04* (2006.01)
*B22C 9/10* (2006.01)

(58) Field of Classification Search
USPC ..... 164/138, 349, 520–529
See application file for complete search history.

(56) References Cited

U.S. PATENT DOCUMENTS 4,385,656 A * 5/1983 Takahashi ..... B22C 1/2206 106/38.2
5,369,183 A * 11/1994 Okada ..... C08F 259/04 106/38.22
5,711,792 A * 1/1998 Miller ..... B22C 1/185 106/38.2
8,567,481 B2 * 10/2013 Garcia-Tapia ..... B22C 1/188 106/38.3
2005/0090578 A1 * 4/2005 Chang ..... B22C 1/224 523/144
2006/0071364 A1 4/2006 Zenpo et al.
2006/0119018 A1 * 6/2006 Watanabe ..... C04B 35/18 264/651
2010/0326620 A1 * 12/2010 Muller ..... B22C 1/188 164/528
2011/0073270 A1 * 3/2011 Stotzel ..... B22C 3/00 164/47

FOREIGN PATENT DOCUMENTS

JP H07-68343 A 3/1995
JP H07-185731 A 7/1995
JP 2000-343199 A 12/2000
JP 2000-343201 A 12/2000
JP 2001-047213 A 2/2001
JP 2003-010944 A 1/2003
JP 2006-175510 A 7/2006
JP 3948490 B2 7/2007
JP 2010-506730 A 3/2010

OTHER PUBLICATIONS

Jan. 26, 2016 Extended Search Report issued in European Patent Application No. 13855299.7.
Mar. 2, 2017 Office Action issued in Korean Patent Application No. 10-2016-7029173.

* cited by examiner

SAND FOR CASTING MOLD, MANUFACTURING METHOD FOR SAND CASTING-MOLD, AND CORE FOR METAL CASTING

BACKGROUND OF THE INVENTION

Technical Field

The present invention relates to sand for a casting mold, a manufacturing method for a sand casting mold, and a core for metal casting.

Conventionally, binders are added to sand for casting molds for the purpose of improving shape retention properties and the like.

For example, as a material for a casting mold, a molding material mixture for production of casting molds for metalworking has been disclosed, which includes: at least a refractory molding matrix; a binder containing waterglass; a fixed proportion of a particulate metal oxide selected from the group consisting of silicon dioxide, aluminum oxide, titanium oxide, and zinc oxide; and a carbohydrate (see, for example, Japanese National-Phase Publication (JP-A) No. 2010-506730).

While unrelated to binders used in mixture with sand, a die-casting method has been disclosed in which at least one selected from the group consisting of graphite, BN, waterglass, mica, silica gel, magnesium hydroxide, and magnesium oxide is used as an additive for a releasing agent to be applied onto an inner wall of a casting mold (see, for example, Japanese Patent Publication Laid-Open (JP-A) Nos. 2001-47213, 2000-343201 and 2000-343199).

SUMMARY OF INVENTION

Technical Problem

Conventionally, in a molding method using a sand casting-mold, improvement of removability of a sand casting-mold after obtaining a casting product by cooling and solidifying a molten metal, has been required. Therefore, from the viewpoint of removing the sand casting-mold easily, further amelioration of the removability is required. The removability of a sand casting-mold tends to deteriorate when the temperature of the molten metal to be poured in is low. In a case in which a pouring temperature of the molten metal to be poured in is as low as approximately 700° C., such as with an aluminum casting, amelioration of the removability is more urgently required.

JP-A No. 2010-506730 discloses a method in which an organic compound is mixed with a binder containing waterglass in order to prevent the adhesion of sand to a surface of a cast product. However, the organic compound generates a residue such as tar when heated, and therefore, there is a problem in that removal of the residue from a cast product or casting equipment is needed.

Therefore, an object of the invention is to provide sand for a casting mold that allows easy removal of a sand casting-mold from a surface of a cast product. Another object of the invention is to provide a method of manufacturing a sand casting-mold that is used for manufacturing a cast product and can be easily removed from the surface of the cast product thereafter, and a core for metal casting that is used for manufacturing a cast product and can be easily removed from the surface of the cast product thereafter.

Solution to Problem

Means for solving the above problems are as follows.

<1> Sand for a casting mold, including sand, a binder, and an inorganic compound particle having poor water solubility and generating at least one of water vapor or carbon dioxide gas by heat from a molten metal.

<2> The sand for a casting mold according to the item <1>, further including foam generated by foam production, and having a viscosity of from 0.5 Pa·s to 10 Pa·s.

<3> The sand for a casting mold according to the item <1> or the item <2>, wherein the inorganic compound particle includes at least one selected from the group consisting of a carbonate and a hydroxide.

<4> The sand for a casting mold according to any one of the items <1> to <3>, wherein the binder is water soluble and has a foam-producing ability.

<5> The sand for a casting mold according to the item <4>, including, as the binder, at least one selected from the group consisting of an anionic surfactant, a nonionic surfactant and an amphoteric surfactant.

<6> The sand for a casting mold according to the item <5>, wherein a total added amount of the anionic surfactant, the nonionic surfactant and the amphoteric surfactant is from 0.005% by mass to 0.1% by mass with respect to the sand.

<7> The sand for a casting mold according to any one of the items <1> to <6>, including a water soluble sodium silicate as the binder.

<8> The sand for a casting mold according to the item <7>, wherein an added amount of the sodium silicate is from 0.1% by mass to 20.0% by mass with respect to the sand.

<9> The sand for a casting mold according to any one of the items <1> to <8>, including, as the binder, at least one selected from a binder group (A) consisting of polyvinyl alcohol and derivatives thereof, saponin, starch and a derivatives thereof, and other sugars.

<10> The sand for a casting mold according to the item <9>, wherein a total added amount of the binder contained in the binder group (A) is from 0.1% by mass to 20.0% by mass with respect to the sand.

<11> The sand for a casting mold according to any one of the items <1> to <10>, which is used for casting of aluminum or an aluminum alloy.

<12> A method for manufacturing a sand casting-mold, the method including:

(a) a foamed sand mixture preparation process of preparing a foamed sand mixture containing foam by stirring a sand mixture including sand, a water-soluble binder, an inorganic compound particle having poor water solubility and generating at least one of water vapor or carbon dioxide gas by heat from a molten metal, and water, to produce foam in the sand mixture;

(b) a filling process of filling the foamed sand mixture into a cavity for manufacturing a casting mold in a metal mold;

(c) a sand casting-mold manufacturing process of manufacturing a sand casting-mold by evaporating the water from the filled foamed sand mixture and solidifying the foamed sand mixture; and (d) a removal process of removing the manufactured sand casting-mold from the cavity for manufacturing a casting mold.

<13> The method for manufacturing a sand casting-mold according to the item <12>, wherein, in (b) the filling process, the filling of the foamed sand mixture into the cavity for manufacturing a casting mold is performed by direct pressurization by indentation of a piston in a cylinder.

<14> The method for manufacturing a sand casting-mold according to the item <12>, wherein, in (b) the filling process, the filling of the foamed sand mixture into the cavity for manufacturing a casting mold is performed by supplying compressed air to inside a cylinder.

<15> The method for manufacturing a sand casting-mold according to any one of the items <12> to <14>, wherein, in (c) the sand casting-mold manufacturing process, the evaporating of the water from the foamed sand mixture is performed by heat from a heated metal mold.

<16> The method for manufacturing a sand casting-mold according to any one of the items <12> to <14>, wherein, in (c) the sand casting-mold manufacturing process, the evaporating of the water from the foamed sand mixture is performed by a flow of heated air.

<17> The method for manufacturing a sand casting-mold according to any one of the items <12> to <14>, wherein, in (c) the sand casting-mold manufacturing process, the evaporating of the water from the foamed sand mixture is performed by heat from a heated metal mold and by a flow of heated air.

<18> A core for metal casting in which a density of solid content at a central portion thereof is lower than a density of solid content at a surface portion thereof, the core being manufactured by the method for manufacturing a sand casting-mold according to any one of the items <12> to <17>.

<19> A core for metal casting in which a content of a water-soluble binder per volume at a central portion thereof is lower than a content of the water-soluble binder per volume at a surface portion thereof, the core being manufactured by the method for manufacturing a sand casting-mold according to any one of the items <12> to <17>.

Advantageous Effects of Invention

According to the invention, there may be provided sand for a casting mold that allows easy removal of a sand casting-mold from a surface of a cast product. Furthermore, there may be provided a manufacturing method of a sand casting-mold that is used for manufacturing a cast product and may be easily removed from the surface of the cast product thereafter, and a core for metal casting that is used for manufacturing a cast product and may be easily removed from the surface of the cast product thereafter.

DESCRIPTION OF EMBODIMENTS

Hereinafter, an embodiment of the invention is described in detail,

Sand for a casting mold according to the invention includes sand, a binder, and an inorganic compound particle having poor water solubility and generating at least one of water vapor or carbon dioxide gas by heat from a molten metal.

When producing the sand for a casting mold according to the invention, the binder and the inorganic compound particle may be mixed in advance and used as an additive for a sand casting-mold to be used in mixture with the sand.

That is, the additive for a sand casting-mold includes a binder, and an inorganic compound particle having poor water solubility and generating at least one of water vapor or carbon dioxide gas by heat from a molten metal.

By the use of the sand for a casting mold according to the invention in a sand casting-mold for a cast product, the sand casting-mold may be easily removed from the cast product.

Hereinbelow, the mechanism of the invention is explained with reference to the figures.

Figure 1:
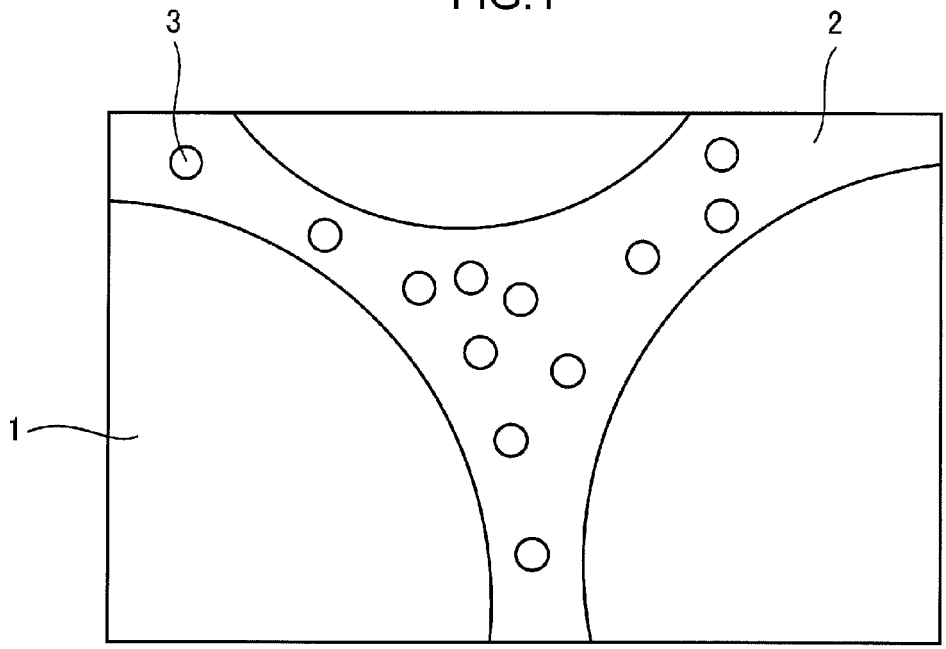
FIG. 1 shows a schematic enlarged view of an internal portion of a sand casting-mold before pouring a molten metal.
Figure 2:
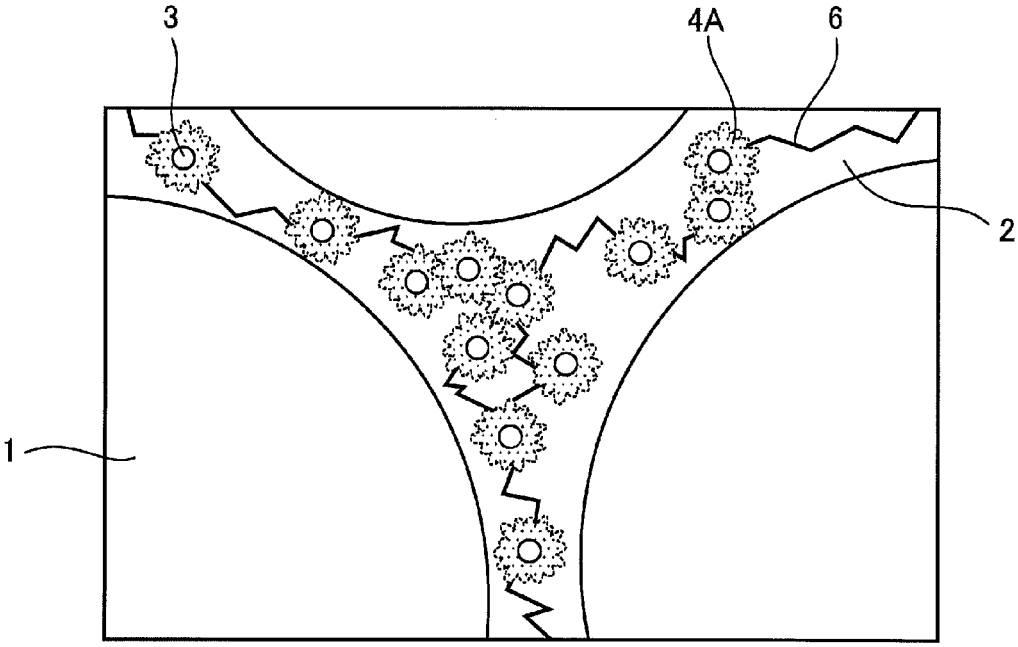
FIG. 2 shows a schematic enlarged view of an internal portion of a sand casting-mold after pouring a molten metal.
Figure 3:
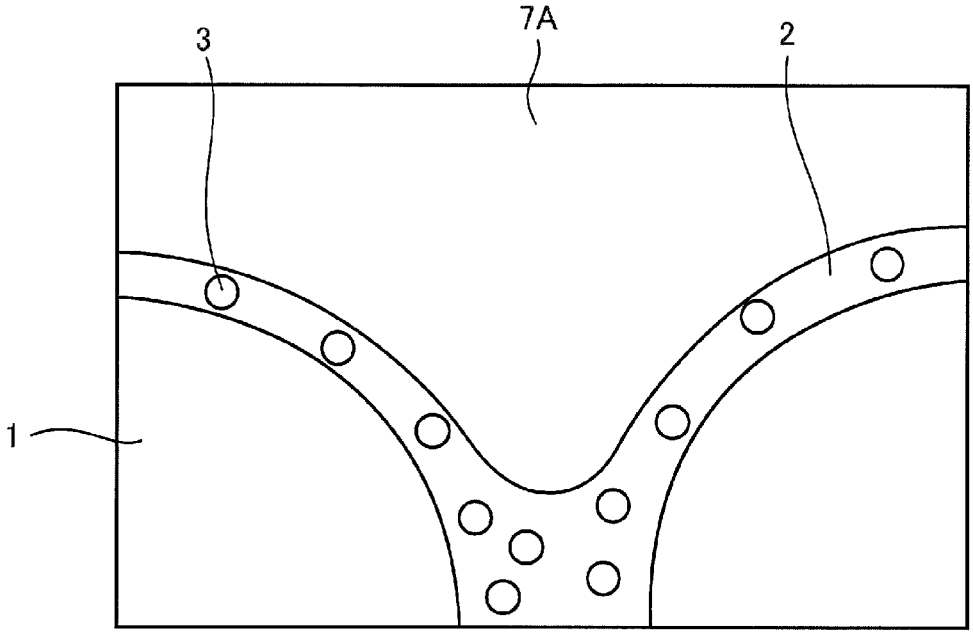
FIG. 3 shows a schematic enlarged view of an interface between a sand casting-mold before pouring a molten metal and a cavity to which the molten metal is to be poured.
Figure 4:
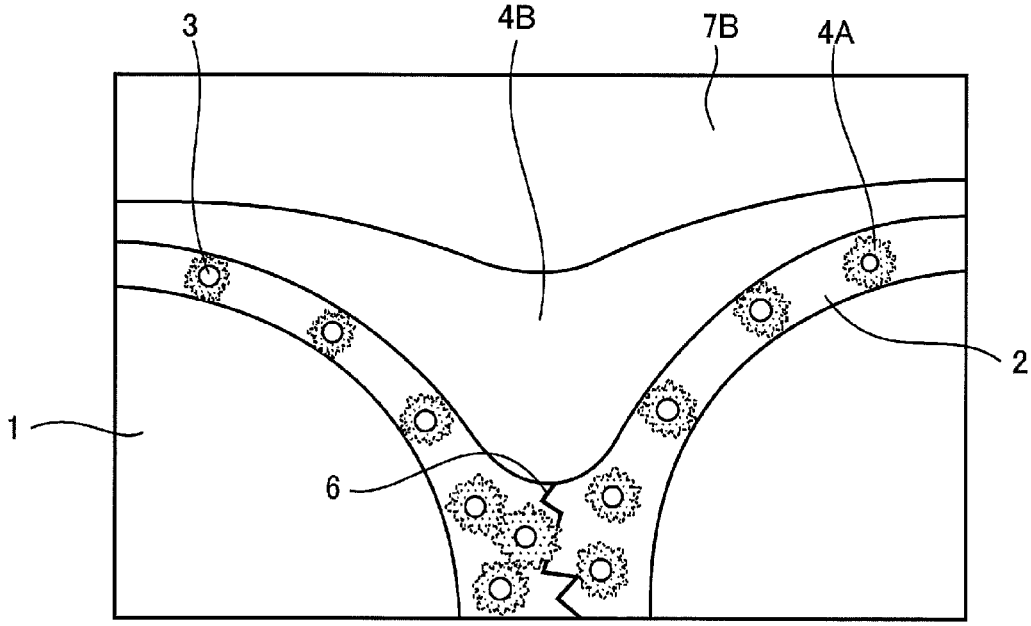
FIG. 4 shows a schematic enlarged view of an interface between a sand casting-mold after pouring a molten metal and a cast product.

Each of the figures represents one of embodiments of the invention. FIG. 1 shows a schematic enlarged view of an internal portion of a sand casting-mold before pouring a molten metal; and FIG. 2 shows a schematic enlarged view of an internal portion of a sand casting-mold after pouring a molten metal. FIG. 3 shows a schematic enlarged view of an interface between a sand casting-mold before pouring a molten metal and a cavity to which the molten metal is to be poured; and FIG. 4 shows a schematic enlarged view of an interface between a sand casting-mold after pouring a molten metal and a cast product.

As shown in FIG. 1, in the internal portion of the sand casting-mold using the sand for a casting mold according to the invention, a binder 2 exists between sand 1 and other sand 1, which enables maintenance of the shape of the sand casting-mold, and an inorganic compound particle 3 is dispersed in the binder 2. As shown in FIG. 2, when a molten metal is poured into the sand casting-mold, gas 4A such as water vapor ($H_2O$) or carbon dioxide gas ($CO_2$) is generated from the inorganic compound particle 3 by heat transfer from the molten metal. For example, in a case in which a magnesium hydroxide particle is used as the inorganic compound particle 3, the particle is heated by the molten metal and generates water vapor at approximately 400° C. by the reaction of "$Mg(OH)_2 \rightarrow MgO+H_2O$". It is conceivable that generation of the gas 4A results in the development of a crack 6 in the binder 2, and it is presumed that the sand casting-mold is easily disintegrated due to the crack 6 and thus removed easily from the cast product.

As shown in FIG. 3, the sand casting-mold using the sand for a casting mold according to the invention is constituted by including the sand 1 and the binder 2 in which the sand 1 and the inorganic compound particle 3 is dispersed, and the sand casting-mold is exposed to a cavity 7A into which a molten metal is to be poured. As shown in FIG. 4, when a molten metal is poured into the cavity 7A, the gas 4A such as water vapor ($H_2O$) or carbon dioxide gas ($CO_2$) is generated from the inorganic compound particle 3 by heat transfer from the molten metal, and it is conceivable that a gas layer 4B is formed between a cast product 7B obtained after cooling the molten metal and the sand casting-mold. It is assumed that adhesion of the sand 1 to the surface of the cast product 7B is reduced due to the gas layer 4B, and thus the sand 1, the binder 2, and the reacted or unreacted inorganic compound particle 3 may be easily removed from the cast product 7B.

Since the sand casting-mold using the sand for a casting mold according to the invention is easily removed from the cast product, in a step of removing the sand casting-mold, the sand casting-mold may be easily removed by using a low-cost and simple equipment such as vibration or air flowing. Therefore, a conventionally used complicated removal method such as a disintegration treatment, a heat treatment, a blasting treatment, or washing may be avoided or the degree of the complicated removal method may be reduced, as a result of which the simplification of the molding process may be realized.

Since the gas 4A generated is water vapor or carbon dioxide gas, a residue (such as tar) derived from an organic gas produced in a case in which an organic compound is mixed with the binder is not generated. Therefore, there is an advantage in that a step of removing the residue from a cast product or a molding equipment is not needed.

The term "sand casting-mold" in the specification is used in a sense that encompasses a sand core.

Hereinafter, a composition for constituting the sand for a casting mold according to the invention is described in detail.

Inorganic Compound Particle

As the inorganic compound particle in the invention, an inorganic compound particle having poor water solubility is used. Here, the term "poor water solubility" is defined as a dissolution amount of 100 mg or less when dissolved in 1 L of water at 25° C.

In a case in which the inorganic compound particle having poor water solubility is used, the particle remains undissolved and the shape thereof is maintained even when the binder contains water, and therefore the inorganic compound particle is sufficiently dispersed in the binder.

The dissolution amount may be adjusted to the above numerical range by selecting a material for constituting the inorganic compound particle.

The inorganic compound particle in the invention is a particle that generates at least one of water vapor or carbon dioxide gas by heat from a molten metal. That is, the inorganic compound particle is configured such that it includes an inorganic compound that generates at least one of water vapor or carbon dioxide gas by heat from a molten metal.

Examples of the inorganic compound used for the inorganic compound particle include a carbonate, a hydroxide and the like, and specific examples thereof include the following. Here, the decomposition temperature described below indicates the temperature range at which water vapor or carbon dioxide gas generates.

Carbonate

Calcium carbonate (decomposition temperature: 775° C. to 875° C.)

Magnesium carbonate (decomposition temperature: 300° C. to 400° C.)

Hydroxide

Magnesium hydroxide (decomposition temperature: 350° C. to 450° C.)

Aluminum hydroxide (decomposition temperature: 250° C. to 350° C.)

In a case in which a molten metal having a relatively-high pouring temperature is used, heat with comparatively-high temperature is also transferred to the inorganic compound particles contained in the sand casting-mold. Therefore, the inorganic compound with a relatively-high decomposition temperature is also preferably used.

Among the above-described inorganic compounds, magnesium hydroxide is preferable from the viewpoint that it has a relatively-low decomposition temperature, that water vapor and/or carbon dioxide gas sufficiently generate even when a molten metal having a relatively-low pouring temperature, such as aluminum or an aluminum alloy, is used, and that thereby the sand casting-mold is easily removed from the resulting cast product.

Since aluminum hydroxide and magnesium carbonate generate water vapor and/or carbon dioxide gas at low temperature, water vapor and/or carbon dioxide gas are also generated during forming of a casting mold by heat drying and a gas layer is formed between a metal mold for manufacturing a casting mold and a casting mold. Therefore, aluminum hydroxide and magnesium carbonate also contribute to improvement in releasing properties between a metal mold and a casting mold.

The inorganic compound particle in the invention preferably contains the inorganic compound such as one listed above at an amount of 80% by mass or more. A content of the inorganic compound other than inevitable impurities as close to 100% by mass as possible is more preferable.

In a case in which the content is more than the above-described lower limit, water vapor and/or carbon dioxide gas are sufficiently generated.

The inorganic compound particle in the invention has preferably a particle diameter that enables it to be sufficiently dispersed in the binder. More specifically, the particle diameter is preferably smaller than that of sand to be used, more preferably from 100 nm to 100 μm, and still more preferably from 500 nm to 10 μm.

In a case in which the particle diameter is smaller than the above-described upper limit, the inorganic compound particle may be sufficiently dispersed in the binder. Meanwhile, in a case in which the particle diameter is larger than the above-described lower limit, the generation amount of water vapor and/or carbon dioxide gas from one inorganic compound particle may be appropriately controlled and the sand cast-mold may be effectively disintegrated.

The particle diameter described above means a volume average particle diameter, and represents here a particle diameter measured by the following method.

A laser diffraction particle size distribution analyzer SALD 2100, trade name, manufactured by Shimadzu Corporation is used as a measurement apparatus for the particle diameter. The measurement conditions are as follows. A dispersion liquid in which 5% by mass of sodium hexametaphosphate (manufactured by Kishida Chemical Co., Ltd., First-grade) as a dispersant is added to water is prepared. The inorganic compound particle is added to the dispersion liquid, and the mixture is subjected to a sonication treatment for 5 minutes in an ultrasonic bath (vibration frequency: 38 kHz, 100 W) provided with the apparatus. The particle size of the resultant is measured using the laser diffraction particle size distribution analyzer SALD 2100 under the condition of a refractive index of 1.70-0.20i.

An addition amount of the inorganic compound particle in the invention to the sand is preferably in a range of from 0.01% by mass to 10% by mass, and more preferably from 0.1% by mass to 1% by mass.

In a case in which the addition amount is more than the above-described lower limit, water vapor and/or carbon dioxide gas are effectively generated and the sand casting-mold may be more easily removed from the cast product. Meanwhile, in a case in which the addition amount is less than the above-described upper limit, the effect of the binder may be efficiently exhibited.

Sand

The sand in the invention is not particularly limited, and any conventionally known sand may be used. Example thereof include silica sand, alumina sand, olivine sand, chromite sand, zirconium sand, mullite sand and the like. In addition, various kinds of artificial sand (so-called artificial aggregate) may be used.

Among these, the artificial sand is preferable from the viewpoint that sufficient strength of the casting mold may be easily obtained even when the addition amount of the binder with respect to the sand is decreased and that a high rate of sand reclamation may be easily achieved.

A particle diameter of the sand in the invention is preferably from 10 μm to 1 mm, more preferably from 50 μm to 500 μm.

In a case in which the particle diameter is smaller than the above-described upper limit, an excellent flowability is obtained and the filling property when manufacturing the sand casting-mold is improved. In a case in which the particle diameter is larger than the above-described lower limit, the breathability of the sand casting-mold is sufficiently maintained.

The particle diameter of the sand may be measured in a method substantially similar to the above-described method of measuring the particle diameter of the inorganic compound particle.

The shape of the sand in the invention is not particularly limited, and may be any of a round shape, a rounded rectangle shape, a polygonal shape, a crystalline shape or the like. Among these, the round shape is preferable from the viewpoints that an excellent flowability is obtained, that the filling property when manufacturing the sand casting-mold is improved, and that the breathability of the sand casting-mold is sufficiently maintained.

Binder

From the viewpoint of sufficiently maintaining the shape of the sand casting-mold at room temperature and in a temperature region of the molten metal to be poured, a binder is included in the sand for the purpose of imparting caking capacity to the sand.

The binder in the invention is not particularly limited, and any conventionally known binder may be used. Examples thereof include waterglass, a synthetic resin (such as a phenol resin, a furan resin, or a urethane resin), cement (such as Portland cement), bentonite, clay, starch and the like.

Among these, from the viewpoint that odor and fume are not generated by heat transfer from the molten metal, the waterglass is preferable.

The waterglass is preferably one having a molar ratio (a molecular ratio of $SiO_2.Na_2O$) of from 1.2 to 3.8, and more preferably one having a molar ratio of from 2.0 to 3.3. In a case in which the waterglass has a molar ration of larger than the above-described lower limit, there is an advantage in that the change of properties of the waterglass may be suppressed even after long-term storage under low temperature. In a case in which the waterglass has a molar ration of lower than the above-described upper limit, there is an advantage in that the viscosity of the binder is easily adjusted.

In manufacturing the sand casting-mold using the sand for a casting mold according to the invention, it is preferable to prepare a foamed sand mixture by using a water-soluble binder, mixing it together with the sand, the inorganic compound particle, and the like, and producing foam by stirring them, and then manufacture the sand casting-mold.

Here, the term "water soluble" means soluble in water at room temperature (20° C.), and more specifically means that a solution obtained by mixing with the same volume of water exhibits a homogenous appearance under a pressure of 1 atmosphere at 20° C.

The water-soluble binder is preferably a binder with a foam-producing ability, from the viewpoint of efficiently producing the foam in the sand mixture. Examples of the water-soluble binder with a foam-producing ability include an anionic surfactant, a non-ionic surfactant, an amphoteric surfactant, a silicate soda, polyvinyl alcohol or a derivative thereof, saponin, starch or a derivative thereof, other sugar and the like. Examples of the other sugar include polysaccharides such as cellulose and fructose, tetrasaccharides such as acarbose, trisaccharides such as raffinose and maltotriose, disaccharides such as maltose, lactose, and trehalose, monosaccharides such as glucose, fruit sugar, other oligosaccharides and the like.

Examples of the anionic surfactant include sodium salt of a fatty acid, a monoalkyl sulfate, a linear sodium alkylbenzene sulfonate, sodium lauryl sulfate, a sodium ether sulfate and the like. Examples of the non-ionic surfactant include a polyoxyethylene alkyl ether, a sorbitan fatty acid ester, an alkyl polyglucoside and the like. Examples of the amphoteric surfactant include cocamidopropyl betaine, cocamidopropyl hydroxysultaine, lauryl dimethyl aminoacetic acid betaine and the like.

The binder may be used singly from the above-listed ones, or in combination of two or more kinds thereof. However, it is preferable to use at least one selected from the group consisting of the waterglass, the synthetic resin, the cement, the bentonite, the clay, and the starch in combination with at least one selected from the water-soluble binder with a foam-producing ability.

A content of the binder with respect to the sand in the invention is preferably set depending on the kinds of the binder and the sand to be used.

For example, the content of the waterglass with respect to the sand is preferably from 0.01% by mass to 20% by mass, and more preferably from 0.1% by mass to 10% by mass.

A content of the phenol resin with respect to the sand is preferably from 4% by mass to 7% by mass; a content of the furan resin with respect to the sand is preferably from 2% by mass to 3% by mass; a content of the urethane resin with respect to the sand is preferably from 2% by mass to 3% by mass; and a content of the Portland cement with respect to the sand is preferably from 6% by mass to 12% by mass.

A total content of each of the anionic surfactant, the non-ionic surfactant, and the amphoteric surfactant with respect to the sand is preferably from 0.005% by mass to 0.1% by mass, and more preferably from 0.01% by mass to 0.05% by mass.

A content of the silicate soda with respect to the sand is preferably from 0.1% by mass to 20.0% by mass, and more preferably from 0.2% by mass to 5% by mass.

A total content of the polyvinyl alcohol or a derivative thereof, the saponin, the starch or a derivative thereof, and the other sugar (binder group (A)) with respect to the sand is preferably from 0.1% by mass to 20.0% by mass, and more preferably from 0.2% by mass to 5% by mass.

Other Composition

Other than the above compositions, a conventionally known composition such as a catalyst, an oxidation accelerator, or the like may be added to the sand for a casting mold according to the invention.

Kneading Method

The sand for a casting mold according to the invention is manufactured by adding and mixing the above-described various compositions. The order of the addition and the method of kneading are not particularly limited. For example, the method is preferably a method in which an additive for the sand casting-mold is prepared in advance by mixing the binder and the inorganic compound particles, and then the additive for the sand casting-mold is mixed with the sand.

Hereinbelow, an additive for the sand casting-mold is described.

Additive for Sand Casting-Mold

The additive for the sand casting-mold includes the binder and the inorganic compound particle having poor water solubility and generating at least one of water vapor or carbon dioxide gas by heat from a molten metal.

A content of the inorganic compound particle with respect to the binder is preferably adjusted such that the content of the inorganic compound particle with respect to the sand falls within the above-described range when the content of the binder with respect to the sand is set within the above-described range.

As a dispersing apparatus used when adding the inorganic compound particle to the binder and mixing them for dispersing the particle, a conventionally known dispersing apparatus may be used without any particular limitation. For example, a homogenizer, an ultrasonic dispersing apparatus, a bead mill or the like may be used.

As a kneading apparatus used when adding the additive for the sand casting-mold, other composition, and the like to the sand and mixing them for kneading, a conventionally known kneading apparatus may be used without any particular limitation. For example, a planetary centrifugal mixer, an EIRICH intensive mixer, Sinto Simpson's "Mix Muller" or the like may be used.

In manufacturing the sand for a casting mold according to the invention, the additive for the sand casting-mold is not necessarily prepared in advance by mixing the binder and the inorganic compound particle. For example, the sand for a casting mold according to the invention may be manufactured by adding the binder to the sand and kneading the mixture, and then further adding the inorganic compound particle to the resultant and kneading them. Alternatively, the sand for a casting mold according to the invention may be manufactured by adding the inorganic compound particle to the sand and kneading the mixture, and then further adding the binder to the resultant and kneading them. The above-described kneading apparatus is also preferably employed as a kneading apparatus used for this process.

Manufacturing Method for Sand Casting-Mold

The manufacture of the sand casting-mold using the sand for a casting mold according to the invention may be manufacture with a molding machine, or may be manufacture by bench molding.

As the molding machine that may be used, a conventionally known molding machine may be used without any particular limitation. Examples thereof include a jolt molding machine, a squeeze molding machine, a jolt squeeze molding machine, a high pressure molding machine, a blow squeeze molding machine, a sand stringer molding machine, a blow molding machine, a plunger injection molding machine, a three-dimensional molding machine and the like.

From the viewpoint of effectively generating water vapor and/or carbon dioxide gas during manufacture of cast products by the addition of the inorganic compound particle, it is preferable to prepare a foamed sand mixture by mixing and stirring the water-soluble binder, the sand, the inorganic compound particle, and the like to produce foam, and then manufacture the casting mold by injecting the foamed sand mixture into a heated cavity for manufacturing a casting mold of a metal mold for manufacturing a casting mold.

More specifically, it is preferable to manufacture the sand casting-mold by the manufacturing method including the following steps a) to d).

a) a foamed sand mixture preparation step of preparing a foamed sand mixture containing foam by stirring a sand mixture including the sand, the water-soluble binder, the inorganic compound particle, and water to produce foam therein.

b) a filling step of filing a cavity for manufacturing a casting mold of a metal mold with the foamed sand mixture.

c) a step of manufacturing a sand casting-mold of manufacturing a sand casting-mold by evaporating the water from the filled foamed sand mixture to solidify the foamed sand mixture.

d) a removal step of removing the manufactured sand casting-mold from the cavity for manufacturing a casting mold.

In the foamed sand mixture injected and filled into a metal mold demarcating the cavity for manufacturing a casting mold and heated to high temperature, a phenomenon of accumulating the foam having been dispersed in the foamed sand mixture by stirring and the water vapor generated from the water in the foamed sand mixture by heat transfer from the heated metal mold in a center portion of the sand casting-mold is caused. As a result, the sand casting-mold has a low filling density of the sand, the binder, and the inorganic compound particle (that is, a density of the solid content) at the center portion, while the sand casting-mold has a high filling density of the sand, the binder, and the inorganic compound particle (the density of the solid content) at the surface portion.

Since heat of a molten metal is most effectively conducted to the surface of a sand casting-mold during manufacturing a cast product, it is preferable that the inorganic compound particle exists especially in the surface portion of the sand casting-mold. Since the density of the inorganic compound particle is high at the surface portion of the sand casting-mold manufactured by injecting the foamed sand mixture into the heated cavity for manufacturing the casting mold, the addition amount of the inorganic compound particle is quite effectively reduced.

With regard to the sand casting-mold, whether the density of the solid content in the central portion is lower or not than the density of the solid content in the surface portion may be determined by visually confirming the degree of filling of the solid content (the sand, the binder, and the inorganic compound particle) in a cross section of the central portion and on the surface of the sand casting-mold.

In the sand casting-mold, a content ratio of the water-soluble binder per volume in the central portion is lower than a content ratio of the water-soluble binder per volume in the surface portion. As a result, the strength of the casting mold is greatly reduced by merely weaken the caking power of the binder in the surface portion by heat from the molten metal during molding, and therefore the removal of the sand casting-mold from the cast product is further facilitated.

With regard to the sand casting-mold, whether the content ratio of the water-soluble binder per volume in the central portion is lower or not than the content ratio of the water-soluble binder per volume in the surface portion may be confirmed by sampling the central portion and the surface portion of the sand casting-mold and determining by a heat loss measurement or an alkali content elution measurement.

In order to improve the filling property with respect to the cavity for manufacturing a casting mold and to achieve the above-described filling density, it is preferable to foam the sand mixture until whipped creamy. More specifically, the viscosity of the foamed sand mixture (that is, the sand for a molding cast) is preferably from 0.5 Pa·s to 10 Pa·s, and more preferably from 1.0 Pa·s to 8 Pa·s.

The measurement of the viscosity of the foamed sand mixture (that is, the sand for a molding cast) is performed as described below.

Measurement Method

The foamed sand mixture is charged into a cylindrical container having an inside diameter of 42 mm and a pore with a diameter of 6 mm at the bottom. The foamed sand mixture is discharged from the pore when pressurized with one's own weight of a cylindrical weight having a weight of 1 kg and a diameter of 40 mm. At this time, the duration of time required for the weight to travel 50 mm is measured, and the viscosity is determined by the following equation.

$$\mu=\pi D^4 P_p t/128 L_1 L_2 S \quad \text{Equation:}$$

μ: viscosity [Pa·s]

D: diameter of the pore in the bottom [m]

$P_p$: pressure of the weight [Pa]

t: duration of time required for the weight to travel 50 mm [s]

$L_1$: travel distance of the weight (=50 mm)

$L_2$: thickness of the pore in the bottom [m]

S: average value of an area of the bottom of the cylindrical weight and a cross-sectional area of a hollow region (that is, the bore portion) inside of the cylindrical container [$m^2$]

Example of a filling method of the foamed sand mixture to the cavity for manufacturing a casting mold include piston direct pressurization in a cylinder, filling by supplying compressed air to inside a cylinder, pressure filling with a screw or the like, and slushing. From the viewpoints of filling speed and filling stability by homogenous application of pressure to the foamed sand mixture, piston direct pressurization and filling by supplying compressed air are preferable.

The vaporization of the water in the foamed sand mixture filled into the cavity for manufacturing a casting mold is performed, for example, by heat from the heated metal mold, flow of heated air to the cavity for manufacturing a casting mold, or a combination thereof.

Manufacture of Cast Product Using Sand Casting-Mold

The sand casting-mold employing the sand for a casting mold according to the invention is used for molding various metals or alloys. Examples of a material of a molten metal used for molding include the followings. Here, the pouring temperature described below indicates a temperature at which the material melts to an extent appropriate for pouring.

Aluminum or an aluminum alloy (pouring temperature: 670° C. to 700° C.)

Iron or an iron alloy (pouring temperature: 1300° C. to 1400° C.)

Bronze (pouring temperature: 1100° C. to 1250° C.)

Brass (pouring temperature: 950° C. to 1100° C.)

The molding is conducted by pouring the molten metal of the above-listed material to the cavities in the sand casting-mold and the metal mold and then cooling them to remove the sand casting-mold.

In the invention, since the sand casting-mold employs the sand for a casting mold according to the invention, the sand casting-mold may be easily removed from the cast product. Therefore, the removal of the sand casting-mold may be performed with a low cost and simple equipment such as vibration or air flowing. Even when the sand casting-mold cannot be completely removed with only a simple equipment such as vibration or air flowing, the degree of the complicated removal method such as a conventionally used disintegration treatment, heat treatment, blasting treatment, or washing may be reduced. As a result, energy-saving and cost-cutting of the molding process may be realized.

Conventionally, the removability of the sand casting-mold tends to be deteriorated when the temperature of the molten metal to be poured is low. For example, in the case of an aluminum casting using aluminum or an aluminum alloy, the pouring temperature is relatively low and therefore the removability tends to be deteriorated. On the other hand, in the invention, since the sand casting-mold employs the sand for a casting mold according to the invention, the sand casting-mold may be easily removed from the cast product even in the case of molding of aluminum or an aluminum alloy.

The disclosure of Japanese Patent Application No. 2012-253658 is incorporated herein by reference in its entirety.

All publications, patent applications, and technical standards mentioned in this specification are herein incorporated by reference to the same extent as if each individual publication, patent application, or technical standard was specifically and individually indicated to be incorporated by reference.

EXAMPLES

Hereinafter, the present invention is described in detail with reference to Examples, but the present invention is not limited to these examples. Here, "part(s)" represents "part(s) by mass" unless otherwise specified.

Example 1

Preparation of Additive for Sand Casting-Mold

The following compositions were mixed, and the mixture was subjected to a dispersion treatment with a dispersing apparatus (homogenizer T-25, trade name, manufactured by IKA), thereby obtaining an additive 1 for a sand casting-mold.

Binder: 0.5 parts (waterglass, mole ratio: 2.0, manufactured by Fuji Kagaku Corp. No. 1)

Inorganic compound particle: 1.0 part (magnesium hydroxide particle, purity: 95% by mass, decomposition temperature: 350° C. to 450° C., dissolution amount with respect to 1 L of water: 12 mg, particle diameter: 3.5 μm, manufactured by Kishida Chemical Co., Ltd., magnesium hydroxide)

Water-soluble binder with foam-producing ability (anionic surfactant): 0.030 parts (sodium salt of ether sulfate, manufactured by ADEKA Corporation)

Manufacture of Sand for Casting Mold

The following compositions were mixed, and the mixture was kneaded and foamed with a kneading apparatus (type 5DM-r, trade name, manufactured by DALTON Co. Ltd.) until whipped creamy, thereby obtaining sand 1 for a casting mold. The viscosity of the sand was measured with the above-described method and found to be 2.3 Pa·s.

Sand (silica sand, particle diameter: 200 μm): 100 parts

Additive 1 for sand casting-mold: 1.5 parts

Manufacture of Sand Casting-Mold

Using a molding machine (LYTE-1, trade name, manufactured by Sintokogyo Ltd.) and a metal mold for a core mold for a stopper (sand casting-mold) and setting the conditions of the molding machine to a pressure of plunger injection of 3000 N, an injection speed of 50 mm/sec, a metal mold temperature of 220° C., and a heating time of 60 sec, the sand 1 for a casting mold was injected into the metal mold and then vaporizing the water in the sand to solidify the sand, thereby obtaining a sand casting-mold 1.

By confirming the obtained sand casting-mold in accordance with the above-described method, it was found that the density of the solid content (the sand, the binder, and the inorganic compound particle) in the central portion is lower than the density of the solid content in the surface portion and that the content ratio of the water-soluble binder per volume in the central portion is lower than the content ratio of the water-soluble binder per volume in the surface portion Manufacture of Cast Product A molten metal of an aluminum alloy (composition/AC4C (JIS H 5202: 1999), pouring temperature: 680° C.) was prepared. The sand casting-mold 1 was arranged in the metal mold as the core mold for a stopper, and the molten metal was poured into the metal mold. The molten metal was then solidified by cooling. The sand casting-mold 1 after cooling was visually observed, and generation of cracks was confirmed.

A vibration machine (HM 0810, trade name, manufactured by Makita Corporation) was used for removing the sand casting-mold 1 from the solidified cast product of the stopper thus obtained, and a vibration was produced in the sprue for 30 seconds under a condition of impacting number of 2900 times/min. The sand casting-mold 1 was disintegrated by the vibration and removed from the cast product. As a result of the visual observation of the surface of the cast product, the attachment of sand and the like was not detected, and the sufficient removal of the sand casting-mold was confirmed.

Examples 2 to 4

Each of sand casting-molds was manufactured in a manner substantially similar to the method described in Example 1, except that the addition amount of the inorganic compound particle (magnesium hydroxide particle) in the preparation of the additive for a sand casting-mold was changed from 1 part to 0.5 parts, 0.3 parts, or 0.1 parts, thereby changing the addition amount of the inorganic compound particle with respect to the sand to the value shown in the following Table 1, and cast products were manufactured and evaluated.

Evaluation

With regard to Examples 1 to 4, the residual amount of the sand remained on or attached to the cast product was measured. Here, the original mass of the sand casting-mold was 65 g.

The residual state of the sand inside and on the surface of the cast product was evaluated in accordance with the following evaluation criteria.

C: sand was remained inside of the cast product and attached to the surface of the cast product B: sand was slightly attached to the surface of the cast product A: no sand was remained The evaluation results are shown in the following Table 1.

TABLE 1

| | Examples | | | |
|---|---|---|---|---|
| | No. 1 | No. 2 | No. 3 | No. 4 |
| Addition amount of magnesium hydroxide [% by mass] | 1.0 | 0.5 | 0.3 | 0.1 |
| Residual amount of sand remained [g] | 0 | 0 | 0 | less than 2 |
| Residual state of sand | A | A | A | B |

Examples 5 to 7

Each of sand casting-molds was manufactured in a manner substantially similar to the methods described in Examples 1 to 3, except that the inorganic compound particle used in the preparation of the additive for a sand casting-mold was changed from the magnesium hydroxide particle to an aluminum hydroxide particle (purity: 99% by mass, decomposition temperature: 250° C. to 350° C., dissolution amount with respect to 1 L of water: 1 mg, particle diameter: 50 μm, manufactured by Kishida Chemical Co., Ltd., aluminum hydroxide), and cast products were manufactured and evaluated. The evaluation results are shown in the following Table 2.

TABLE 2

| | Examples | | |
|---|---|---|---|
| | No. 5 | No. 6 | No. 7 |
| Addition amount of aluminum hydroxide [% by mass] | 1.0 | 0.5 | 0.3 |
| Residual amount of sand remained [g] | less than 2 | less than 2 | less than 2 |
| Residual state of sand | B | B | B |

Comparative Example 1

A sand casting-mold was manufactured in a manner substantially similar to the method described in Example 1, except that no inorganic compound particle was added in the preparation of the additive for a sand casting-mold, and a cast product was manufactured and evaluated. The evaluation results are shown in the following Table 3.

Comparative Examples 2 to 5

Each of sand casting-molds was manufactured in a manner substantially similar to the methods described in Examples 1 to 4, except that the inorganic compound particle used in the preparation of the additive for a sand casting-mold was changed from the magnesium hydroxide particle to a magnesium oxide particle (purity: 90% by mass, dissolution amount with respect to 1 L of water: 86 mg, particle diameter: 3.5 μm, manufactured by Kishida Chemical Co., Ltd., magnesium oxide) that generates no gas by heat from the molten metal, and cast products were manufactured and evaluated. The evaluation results are shown in the following Table 3.

TABLE 3

| | Comparative Examples | | | | |
|---|---|---|---|---|---|
| | No. 1 | No. 2 | No. 3 | No. 4 | No. 5 |
| Addition amount of magnesium oxide [% by mass] | no addition | 1.0 | 0.5 | 0.3 | 0.1 |
| Residual amount of sand remained [g] | 12 | 11 | 11 | 11 | 12 |
| Residual state of sand | C | C | C | C | C |

EXPLANATION OF SIGN IN FIGURES

1 Sand
2 Binder
3 Inorganic compound particle
4A Gas
4B Gas layer
6 Crack
7A Cavity
7B Cast product

What is claimed is:

1. Sand for a casting mold, comprising:
sand particles;
a binder;
foam generated by foam production; and
inorganic compound particles:
having poor water solubility;
generating at least one of water vapor or carbon dioxide gas by heat from a molten metal;
having a volume average particle diameter smaller than that of the sand particles; and
having a viscosity of from 0.5 Pa·s to 10 Pa·s.

2. The sand for a casting mold according to claim 1, wherein the inorganic compound particles comprise at least one selected from a group consisting of a carbonate and a hydroxide.

3. The sand for a casting mold according to claim 1, wherein the binder is water soluble and has a foam-producing ability.

4. The sand for a casting mold according to claim 3, comprising, as the binder, at least one selected from a group consisting of an anionic surfactant, a nonionic surfactant and an amphoteric surfactant.

5. The sand for a casting mold according to claim 4, wherein a total added amount of the anionic surfactant, the nonionic surfactant and the amphoteric surfactant is from 0.005% by mass to 0.1% by mass with respect to the sand.

6. The sand for a casting mold according to claim 1, comprising a water soluble sodium silicate as the binder.

7. The sand for a casting mold according to claim 6, wherein an added amount of the sodium silicate is from 0.1% by mass to 20.0% by mass with respect to the sand.

8. The sand for a casting mold according to claim 1, comprising, as the binder, at least one selected from a binder group (A) consisting of polyvinyl alcohol and derivatives thereof, saponin, starch and derivatives thereof, and other sugars.

9. The sand for a casting mold according to claim 8, wherein a total added amount of the binder contained in the binder group (A) is from 0.1% by mass to 20.0% by mass with respect to the sand.

10. The sand for a casting mold according to claim 1, which is used for casting of aluminum or an aluminum alloy.

11. The sand for a casting mold according to claim 1, wherein
the inorganic compound particles comprise at least one selected from the group consisting of magnesium carbonate, magnesium hydroxide, and aluminum hydroxide.

12. The sand for a casting mold according to claim 11, wherein the binder is water soluble and has a foam-producing ability.

13. The sand for a casting mold according to claim 12, comprising, as the binder, at least one selected from a group consisting of an anionic surfactant, a nonionic surfactant and an amphoteric surfactant.

14. The sand for a casting mold according to claim 13, wherein a total added amount of the anionic surfactant, the nonionic surfactant and the amphoteric surfactant is from 0.005% by mass to 0.1% by mass with respect to the sand.

15. The sand for a casting mold according to claim 11, comprising a water soluble sodium silicate as the binder.

16. The sand for a casting mold according to claim 15, wherein an added amount of the sodium silicate is from 0.1% by mass to 20.0% by mass with respect to the sand.

17. The sand for a casting mold according to claim 11, comprising, as the binder, at least one selected from a binder group (A) consisting of polyvinyl alcohol and derivatives thereof, saponin, starch and derivatives thereof, and other sugars.

18. The sand for a casting mold according to claim 17, wherein a total added amount of the binder contained in the binder group (A) is from 0.1% by mass to 20.0% by mass with respect to the sand.

19. The sand for a casting mold according to claim 11, which is used for casting of aluminum or an aluminum alloy.

* * * * *